US005138379A

United States Patent [19]

Kanazashi

[11] Patent Number: 5,138,379

[45] Date of Patent: Aug. 11, 1992

[54] IMAGE FORMING APPARATUS HAVING TEMPERATURE AND HUMIDITY DETECTING MEANS

[75] Inventor: Akihiro Kanazashi, Yokohama, Japan

[73] Assignee: Kabushiki Kaisha Toshiba, Kawasaki, Japan

[21] Appl. No.: 711,039

[22] Filed: Jun. 6, 1991

[30] Foreign Application Priority Data

Jun. 8, 1990 [JP] Japan ..... 2-148479

[51] Int. Cl.[5] ..... G03G 15/20

[52] U.S. Cl. ..... 355/208; 355/290

[58] Field of Search ..... 355/208, 282, 285, 289, 355/290, 295; 219/216, 469

[56] References Cited

U.S. PATENT DOCUMENTS 4,253,392 3/1981 Brandon et al. ..... 219/216 Y
4,672,177 6/1987 Headrick ..... 219/216
4,942,434 7/1990 Nakai et al. ..... 355/290

FOREIGN PATENT DOCUMENTS 1-191185 8/1989 Japan ..... 355/285

*Primary Examiner*—Joan H. Pendegrass
*Attorney, Agent, or Firm*—Foley & Lardner

[57] ABSTRACT

A fixing device comprises a heating roller for heating a paper sheet, a pressure roller in rolling contact with the heating roller and adapted to press the paper sheet against the heating roller, and a temperature sensor and a humidity sensor for detecting the temperature and humidity, respectively, of the outside air. The temperature of the heating roller is controlled and the pressure loading of the pressure roller is controlled in a stepless manner by means of a temperature control section and a pressure control section in accordance with the outside air temperature and humidity detected by means of the temperature and humidity sensors, respectively.

12 Claims, 4 Drawing Sheets

IMAGE FORMING APPARATUS HAVING TEMPERATURE AND HUMIDITY DETECTING MEANS

BACKGROUND OF THE INVENTION

1. Field of the Invention

The present invention relates to a fixing device of, for example, an electronic copying apparatus for fixing an image transferred to a paper sheet.

2. Description of the Related Art

Generally, a fixing device of this type comprises a heating roller and a pressure roller pressed against the heating roller.

As a paper sheet, with an image transferred thereto, passes between the heating roller and the pressure roller, it is heated and pressurized so that the image is fixed.

The temperature of the heating roller is controlled so as to be constant or variable in two stages, and the pressure roller is pressed against the heating roller under a fixed pressure by means of a spring or the like.

Conventionally, however, the temperature of the heating roller and the pressure loading of the pressure roller are substantially fixed without regard to variations in the temperature and humidity of the outside air. If the outside air temperature falls, or if the outside air humidity increases so that the sheet becomes damp, therefore, the fixing efficiency is liable to be lower than in the normal state.

The fixing efficiency can be improved by increasing the pressure loading of the pressure roller. If the pressure loading is increased too much, however, the paper sheet is subjected to so high a pressure that it will be wrinkled or curled.

SUMMARY OF THE INVENTION

The object of the present invention is to provide a fixing device capable of detecting the temperature and humidity of the outside air and most suitably combining the temperature of a heating roller and the pressure loading of a pressure roller, thereby improving the fixing efficiency.

According to the present invention, there is provided a fixing device which comprises: a heating roller for heating a fixing medium; a pressure roller in rolling contact with the heating roller and adapted to press the fixing medium against the heating roller; first detecting means for detecting the environmental temperature around the heating roller; second detecting means for detecting the environmental humidity around the pressure roller; means for controlling the temperature of the heating roller in accordance with the environment temperature detected by the first detecting means; and means for changing the pressure loading between the pressure roller and the heating roller in accordance with the environmental humidity detected by the second detecting means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

A fixing device according to an embodiment of the present invention will now be described with reference to the accompanying drawings.

Figure 2:
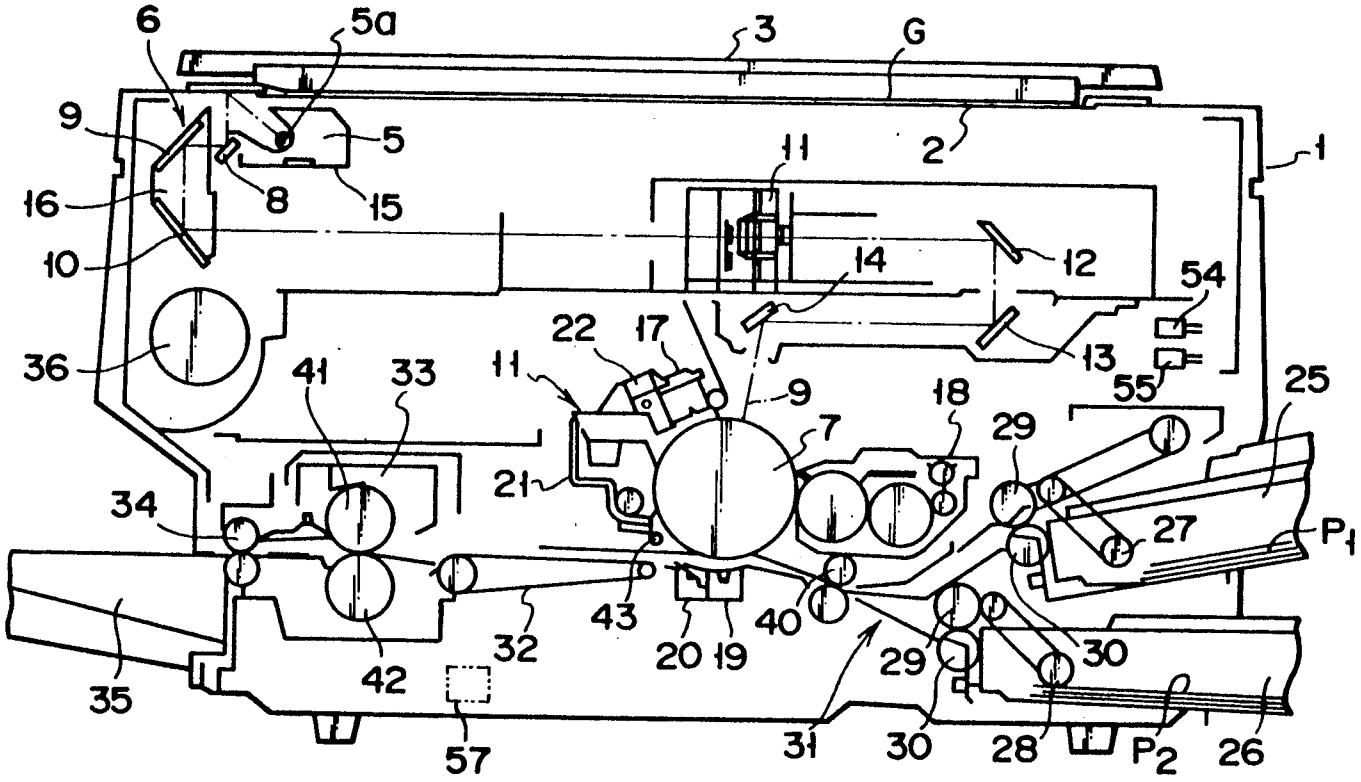
FIG. 2 is an interior view showing an electronic copying apparatus provided with the fixing device of FIG. 1.

In FIG. 2 showing an electronic copying apparatus, numeral 1 denotes an apparatus shell. An original table 2 for carrying an original G and an original cover 3 for covering the table 2 are disposed on the top portion of the shell 1.

An illumination unit 5 for irradiating the original G on the original table 2 is provided on the top side of the interior of the apparatus shell 1. A light beam from the unit 5 applied to the original G is reflected by the original, and is then projected on a photoreceptor drum 7 (mentioned later) by means of an optical system 6.

The optical system 6 is composed of first, second, and third mirrors 8, 9 and 10, a lens 11, and fourth, fifth, and sixth mirrors 12, 13 and 14.

The first mirror 8, along with the illumination unit 5, is mounted on a first carriage 15, and the second and third mirrors 9 and 10 on a second carriage 16.

The first and second carriages 15 and 16 reciprocate along the original table 2, and the second carriage 16 moves at a speed half that of the first carriage 15, thereby maintaining a fixed optical path length.

The photoreceptor drum 7 is mounted in a substantially central portion of the apparatus shell 1 for rotation. A main charger 17 for uniformly charging the surface of the drum 7 is opposed to the top portion of the drum. A developing unit 18 for supplying a developing agent is opposed to one side portion of the drum 7. A transfer charger 19 and a separation charger 20 are opposed to the bottom portion of the drum 7. The charger 19 serves to transfer a developer image on the drum 7 to a paper sheet P1 (P2), while the charger 20 is used to separate the sheet P (P2), having the developer image thereon, from the drum 7. Opposed to the other side portion of the photoreceptor drum 7, moreover, are a cleaning unit 21 for removing the developing agent remaining on the drum 7 and a de-electrifier 22 for de-electrifying the drum surface.

A high-voltage source (HVM) 57 is electrically connected to the main charger 17, for applying a voltage thereto.

First and second paper cassettes 25 and 26, which are used to supply the paper sheets P1 and P2, respectively, are attached to one side portion of the apparatus shell 1.

The sheets P1 and P2 in the first and second cassettes 25 and 26 are picked up one after another by means of pickup rollers 27 and 28, respectively.

Each of the picked-up sheets P1 and P2 is delivered to a paper path 31 by means of a paper-supply roller 29 and a separation roller 30 which are in rolling contact with each other.

Aligning rollers 40 for aligning the sheets P1 and P2 along with the transfer and separation chargers 19 and 20, are disposed in the paper path 31. Arranged in the path 31, moreover, are a conveyor belt 32 for carrying and transporting the sheets P1 and P2 and a fixing unit 33 for fixing images transferred to the sheets.

In FIG. 2, numeral 34 denotes exit rollers for discharging the sheets P1 and P2, and numeral 35 denotes a receiving tray which receives the discharged sheets.

Numeral 36 designates an exhaust fan for discharging air from the apparatus shell 1.

In forming an image, a light beam is applied to the original G on the original table 2 by means of an exposure lamp 5*a*. Then, the light beam is reflected by the original G, and the reflected beam is guided o the lens 11 by means of the first to third mirrors 8 to 10. After being transmitted through the lens 11, the light beam is projected onto the photoreceptor drum 7 via the fourth to sixth mirrors 12 to 14. As a result, an electrostatic latent image is formed on the surface of the drum 7, which is previously charged by means of the main charger 17. This latent image is developed as it is supplied with the developing agent from the developing unit 18. Meanwhile, the sheets P1 or P2 are fed from the upper or lower paper cassette 25 or 26. The sheets P1 or P2 are separated one by one by means of the separation roller 30 and each separated sheet is delivered to the aligning rollers 40 After being aligned by means of the rollers 40, the sheet P1 (P2) is fed to the region between the photoreceptor drum 7 and the transfer charger 19. Thereupon, the image on the drum 7 is transferred to the sheet P1 (P2) by the agency of the charger 19. Thereafter, the sheet P1 (P2) is separated from the drum 7 by the agency of the separation charger 20, and is fed onto the conveyor belt 32. As the belt 32 travels, the sheet P1 (P2) is delivered to the fixing unit 32, whereupon the image is fixed. Thereafter, the sheet P1 (P2) is discharged onto the receiving tray 35 via the exit rollers 34.

After the image transfer described above, toner particles remaining on the photoreceptor drum 7 are removed by means of the cleaning unit 21, and the drum surface is then de-electrified by means of the de-electrifier 22. Thereafter, the drum 7 is charged again by means of the main charger 17 to be ready for the next imaging process.

Figure 1:
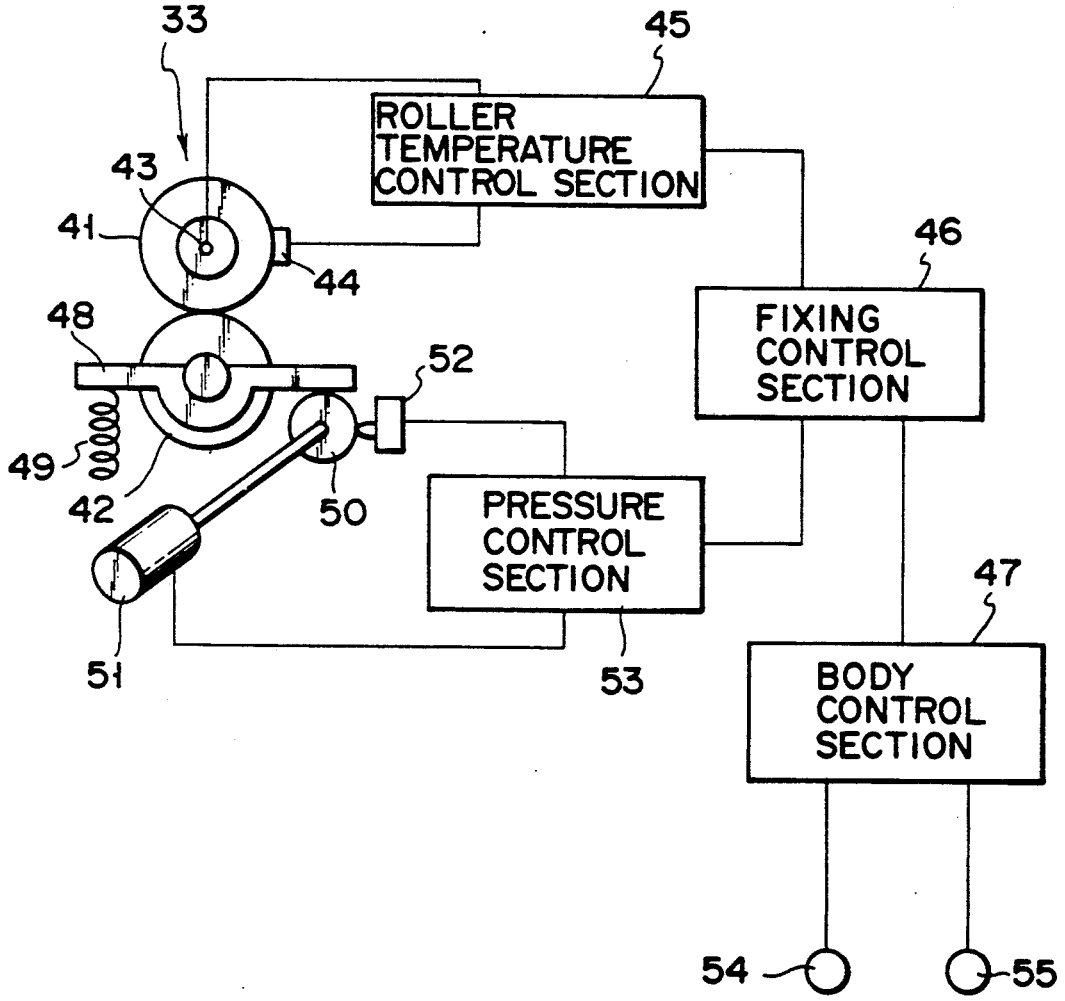
FIG. 1 is a diagram showing a fixing device according to an embodiment of the present invention and a control system therefor.

The fixing unit 33 is constructed in the manner shown in FIG. 1.

In FIG. 1, numeral 41 denotes a heating roller for heating the sheets P1 and P2. A pressure roller 42 is held against the lower part of the heating roller 41 under pressure, whereby the sheet P1 (P2) is pressed against the roller 41.

A heater lamp 43 is disposed in the heating roller 41, and the surface temperature of the roller 41 is detected by means of a thermistor 44. The lamp 43 and the thermistor 44 are connected to a roller temperature control section 45, which is connected to a body control section 47 through a fixing control section 46.

The pressure roller 42 is retained on a substantially central portion of a retaining member 48. One end portion of the member 48 is urged upward by means of a coil spring 49 for use as an urging member. The other end portion of the retaining member 48 is supported by means of a pressure cam 50. The cam 50 is rocked by means of a cam drive motor 51. The rocking position of the cam 50 is detected by means of a cam position sensing switch 52.

The cam drive motor 51 and the cam position sensing switch 52 are connected to a pressure control section 53, which is connected to the fixing control section 46.

The body control section 47 is connected with a temperature sensor 54 and a humidity sensor 55 for use as sensing means. The sensors 54 and 55 are used to detect the temperature and humidity of the outside air, respectively.

The temperature sensor 54 and the humidity sensor 55 are hardly influenced by the heat emanating from the fixing unit 33. In the apparatus shell 1, they are located above the paper-feeding section, as is shown in FIG. 2, and are not influenced by the cooling air applied by the cooling fan 36.

Figures 6A, 6B, 6C:
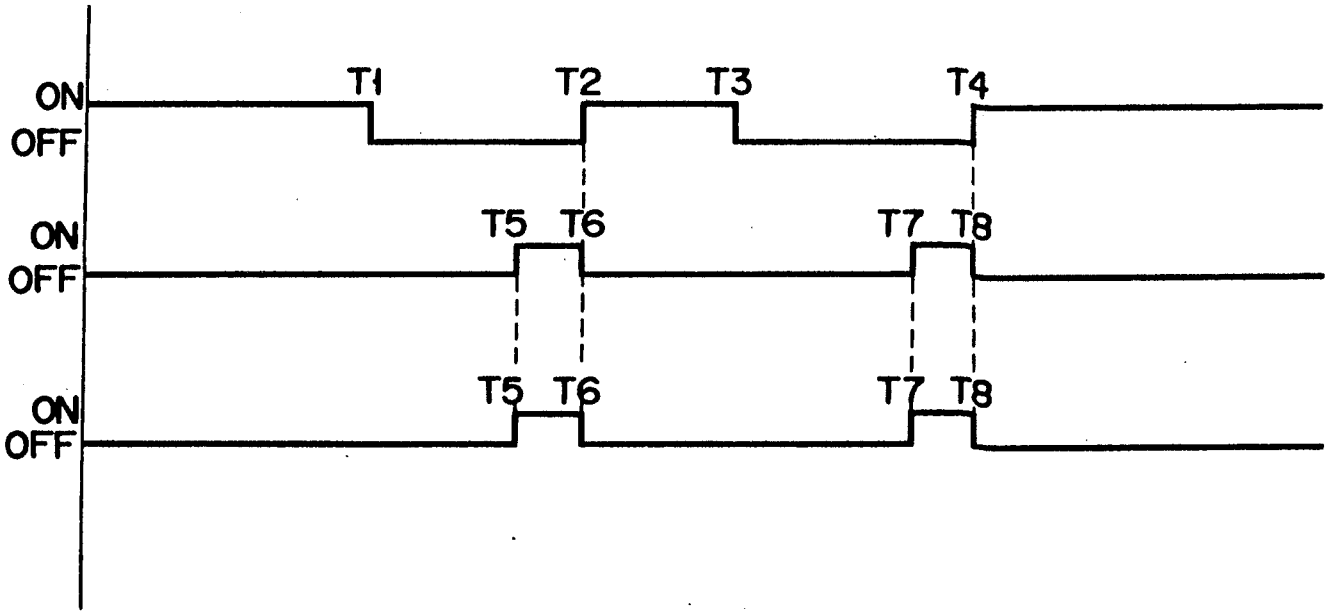
FIG. 6A is a timing chart explaining how a control voltage source operates to control the main charger incorporated in the fixing device shown in FIG. 2.
FIG. 6B is also a timing chart illustrating how the temperature sensor used in the fixing device operates.
FIG. 6C is a timing chart explaining how the humidity sensor used in the fixing device operates.

As is shown in FIG. 6A, the high-voltage source 57 is turned off at times $T_1$ and $T_3$, and is turned off at times $T_2$ and $T_3$.

As is evident from FIGS. 6B and 6C, both sensors 54 and 55 are turned on at times T5 and time T7, shortly before the high-voltage source 57 is turned on at times T2 and T4. The sensors 54 and 55 are turned off at times T6 and T8, as is shown in FIG. 6B and 6C.

In fixing the image, the sheet P1 (P2), with the image thereon, is passed between the heating roller 41 and the pressure roller 42 to be heated and pressurized thereby, whereupon the image is fixed to the sheet P1 (P2).

In the meantime, the outside air temperature and humidity are detected by means of the temperature sensor 54 and the humidity sensor 55, respectively.

The detected temperature is delivered to a roller temperature control section 45 through the body control section 47 and the fixing control section 46. The surface temperature of the heating roller 41 is detected by means of the thermistor 44, and the detected temperature is delivered to the control section 45.

Figure 4:
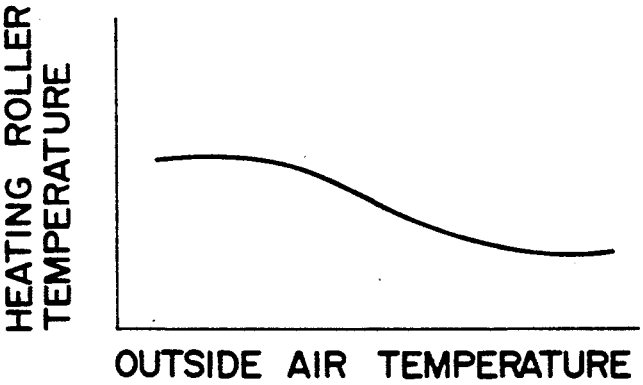
FIG. 4 is a graph illustrating temperature control of the heating roller of the fixing device with respect to the change of the outside air temperature.

The roller temperature control section 45 controls the heat release value of the heater lamp 43 so that the surface temperature of the heating roller 41 falls as the outside air temperature rises, as shown in FIG. 4.

Figure 5:
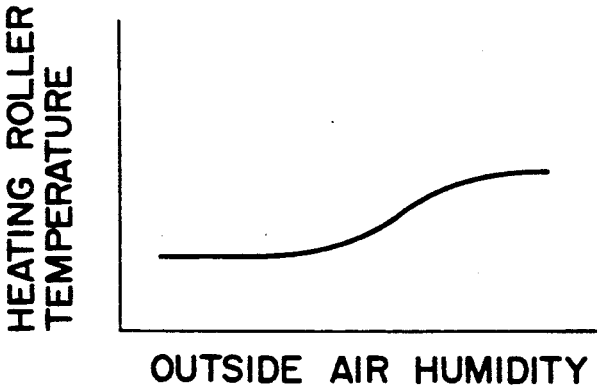
FIG. 5 is a graph illustrating temperature control of the heating roller of the fixing device with respect to the change of the outside air humidity.

The detected humidity is delivered to the roller temperature control section 45 through the body control section 47 and the fixing control section 46. The roller temperature control section 45 controls the heat release value of the heater lamp 43 so that the surface temperature of the heating roller 41 rises as the outside air humidity increases, as shown in FIG. 5.

Figure 3:
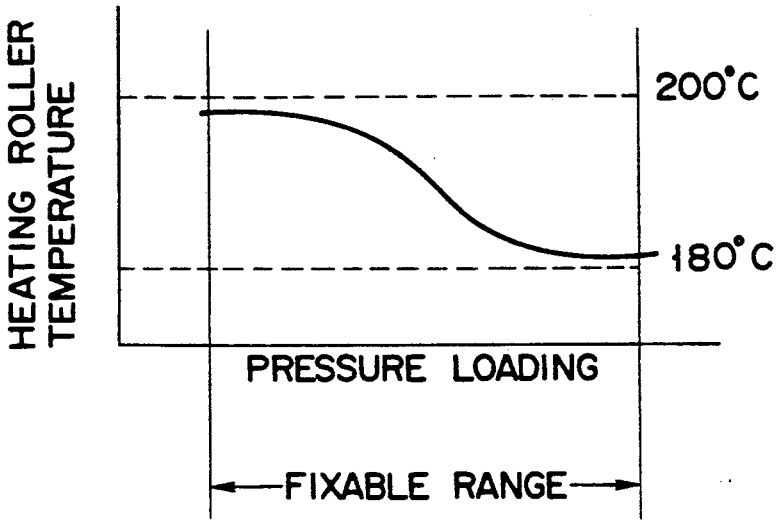
FIG. 3 is a graph illustrating the relationship between the temperature of a heating roller and the pressure loading of a pressure roller, in the fixing device of FIG. 1.

The surface temperature of the heating roller 41 and the pressure loading of the pressure roller 42 are controlled in the relation shown in FIG. 3, that is, in a manner such that the former falls as the latter increases.

The pressure loading of the pressure roller 42 is changed by giving an activation command from the pressure control section 53 to the cam drive motor 51 to rock the pressure cam 50.

If the surface temperature of the heating roller 41 rises to a level higher than a predetermined temperature (200° C.), therefore, it can be lowered to improve the fixing efficiency by increasing the pressure loading of the pressure roller 42.

If the surface temperature of the heating roller 41 is high enough, ranging from 180° to 190° C., for example, the paper sheet can be prevented from being subjected to an excessive pressure loading, and therefore, from being wrinkled or curled, by lowering the pressure of the pressure roller 42 to a certain limit.

Since the surface temperature of the heating roller 41 and the pressure loading of the pressure roller 42 are controlled in accordance with the outside air temperature and humidity, as described above, satisfactory fixing efficiency can be maintained despite the changes of the outside air temperature and humidity.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A fixing apparatus comprising:

a heating roller for heating a fixing medium;

a pressure roller in rolling contact with the heating roller and adapted to press the fixing medium against the heating roller;

first detecting means for detecting the environmental temperature around the heating roller;

second detecting means for detecting the environmental humidity around the pressure roller;

means for controlling the temperature of the heating roller in accordance with the environmental temperature detected by the first detecting means; and means for changing the pressure loading between the pressure roller and the heating roller in accordance with the environmental humidity detected by the second detecting means;

wherein said pressure roller is retained on a substantially central portion of a retaining member, one end portion of which is urged by means of an urging member, and the other end portion of which is supported by means of a cam.

2. A fixing apparatus comprising:

a heating roller for heating a fixing medium;

a pressure roller in rolling contact with the heating roller and adapted to press the fixing medium against the heating roller;

first detecting means for detecting the environmental temperature around the heating roller;

second detecting means for detecting the environmental humidity around the pressure roller;

means for controlling the temperature of the heating roller in accordance with the environmental temperature detected by the first detecting means; and means for changing the pressure loading between the pressure roller and the heating roller in accordance with the environmental humidity detected by the second detecting means;

wherein said heating roller has a heating lamp and said temperature control means controls the heat release value of the heating lamp so that the surface temperature of the heating roller rises as the outside air humidity increases.

3. A fixing apparatus comprising:

a heating roller for heating a fixing medium;

a pressure roller in rolling contact with the heating roller and adapted to press the fixing medium against the heating roller;

first detecting means for detecting the environmental temperature around the heating roller;

second detecting means for detecting the environmental humidity around the pressure roller;

means for controlling the temperature of the heating roller in accordance with the environmental temperature detected by the first detecting means; and means for changing the pressure loading between the pressure roller and the heating roller in accordance with the environmental humidity detected by the second detecting means;

wherein said heating roller has a heating lamp and said temperature control means controls the surface temperature of the heating roller and the pressure loading of the pressure roller so that the former falls as the latter increases.

4. A fixing apparatus comprising:

a heating roller for heating a fixing medium;

a pressure roller in rolling contact with the heating roller and adapted to press the fixing medium against the heating roller;

first detecting means for detecting the environmental temperature around the heating roller;

second detecting means for detecting the environmental humidity around the pressure roller;

means for controlling the temperature of the heating roller in accordance with the environmental temperature detected by the first detecting means; and means for changing the pressure loading between the pressure roller and the heating roller in accordance with the environmental humidity detected by the second detecting means;

wherein said pressure roller is retained on a substantially central portion of a retaining member, one end portion of which is urged by means of an urging member, and the other end portion of which is supported by means of a cam;

wherein said pressure control means controls the pressure loading of the pressure roller on the heating roller by rocking the cam.

5. An image forming apparatus, comprising:

means for forming an unfixed image on an image bearing medium;

means for fixing the unfixed image on the image bearing medium, the fixing means having a heating roller for heating a fixing medium and a pressure roller in rolling contact with the heating roller and adapted to press the fixing medium against the heating roller;

first detecting means for detecting the environmental temperature around the fixing means;

second detecting means for detecting the environmental humidity around the fixing means;

means for controlling the temperature of the heating roller in accordance with the environmental temperature detected by the first detecting means; and means for changing the pressure loading between the pressure roller and the heating roller in accordance with the environmental humidity detected by the second detecting means;

wherein said pressure roller is retained on a substantially central portion of a retaining member, one end portion of which is urged by means of an urging member, and the other end portion of which is supported by means of a cam.

6. An image forming apparatus, comprising:

means for forming an unfixed image on an image bearing medium;

means for fixing the unfixed image on the image bearing medium, the fixing means having a heating roller for heating a fixing medium and a pressure roller in rolling contact with the heating roller and adapted to press the fixing medium against the heating roller;

first detecting means for detecting the environmental temperature around the fixing means;

second detecting means for detecting the environmental humidity around the fixing means;

means for controlling the temperature of the heating roller in accordance with the environmental temperature detected by the first detecting means; and means for changing the pressure loading between the pressure roller and the heating roller in accordance with the environmental humidity detected by the second detecting means;

wherein said heating roller has a heater lamp and said temperature control means controls the heat release value of the heater lamp so that the surface temperature of the heating roller rises as the outside air humidity increases.

7. An image forming apparatus, comprising:

means for forming an unfixed image on an image bearing medium;

means for fixing the unfixed image on the image bearing medium, the fixing means having a heating roller for heating a fixing medium and a pressure roller in rolling contact with the heating roller and adapted to press the fixing medium against the heating roller;

first detecting means for detecting the environmental temperature around the fixing means;

second detecting means for detecting the environmental humidity around the fixing means;

means for controlling the temperature of the heating roller in accordance with the environmental temperature detected by the first detecting means; and means for changing the pressure loading between the pressure roller and the heating roller in accordance with the environmental humidity detected by the second detecting means;

wherein said heating roller has a heater lamp and said temperature control means controls the surface temperature of the heating roller and the pressure loading of the pressure roller so that the former falls as the latter increases.

8. An image forming apparatus, comprising:

means for forming an unfixed image on an image bearing medium;

means for fixing the unfixed image on the image bearing medium, the fixing means having a heating roller for heating a fixing medium and a pressure roller in rolling contact with the heating roller and adapted to press the fixing medium against the heating roller;

first detecting means for detecting the environmental temperature around the fixing means;

second detecting means for detecting the environmental humidity around the fixing means;

means for controlling the temperature of the heating roller in accordance with the environmental temperature detected by the first detecting means; and means for changing the pressure loading between the pressure roller and the heating roller in accordance with the environmental humidity detected by the second detecting means;

wherein said pressure roller is retained on a substantially central portion of a retaining member, one end portion of which is urged by means of an urging member, and the other end portion of which is supported by means of a cam;

wherein said heating roller has a heater lamp and said pressure control means controls the pressure loading of the pressure roller on the heating roller by rocking the cam.

9. A fixing apparatus comprising:

a heating roller for heating a fixing medium;

a pressure roller in rolling contact with the heating roller and adapted to press the fixing medium against the heating roller;

means for detecting the environmental humidity around the heating roller and the pressure roller; and means for changing the pressure loading between the pressure roller and the heating roller in accordance with the environmental humidity detected by the detecting means;

wherein said pressure roller is retained on a substantially central portion of a retaining member, one end portion of which is urged by means of an urging member, and the other end portion of which is supported by means of a cam.

10. A fixing apparatus comprising:

a heating roller for heating a fixing medium;

a pressure roller in rolling contact with the heating roller and adapted to press the fixing medium against the heating roller;

means for detecting the environmental humidity around the heating roller and the pressure roller; and means for changing the pressure loading between the pressure roller and the heating roller in accordance with the environmental humidity detected by the detecting means;

wherein said heating roller has a heater lamp and said temperature control means controls the heat release value of the heater lamp so that the surface temperature of the heating roller rises as the outside air humidity increases.

11. A fixing apparatus comprising:

a heating roller for heating a fixing medium;

a pressure roller in rolling contact with the heating roller and adapted to press the fixing medium against the heating roller;

means for detecting the environmental humidity around the heating roller and the pressure roller; and means for changing the pressure loading between the pressure roller and the heating roller in accordance with the environmental humidity detected by the detecting means;

wherein said heating roller has a heater lamp and said temperature control means controls the surface temperature of the heating roller and the pressure loading of the pressure roller so that the former falls as the latter increases.

12. A fixing apparatus comprising:

a heating roller for heating a fixing medium;

a pressure roller in rolling contact with the heating roller and adapted to press the fixing medium against the heating roller;

means for detecting the environmental humidity around the heating roller and the pressure roller; and means for changing the pressure loading between the pressure roller and the heating roller in accordance with the environmental humidity detected by the detecting means;

wherein said pressure roller is retained on a substantially central portion of a retaining member, one end portion of which is urged by means of an urging member, and the other end portion of which is supported by means of a cam;

wherein said pressure control means controls the pressure loading of the pressure roller on the heating roller by rocking the cam.

* * * * *